United States Patent [19]

Prewer

[11] 4,033,078

[45] July 5, 1977

[54] HOUSING SYSTEMS AND STRUCTURES

[76] Inventor: John R. Prewer, 82 Thomas More House, Barbican, London E.C.2, England

[22] Filed: June 25, 1975

[21] Appl. No.: 590,101

[30] Foreign Application Priority Data

June 28, 1974 United Kingdom ..... 28892/74

[52] U.S. Cl. ..... 52/79.5; 52/83; 52/143; 52/292

[51] Int. Cl.[2] ..... E04H 1/12

[58] Field of Search ..... 52/292, 262, 79, 294, 52/169, 236, 263, 143, 126, 745; 214/1 BE

[56] References Cited

UNITED STATES PATENTS

| | | | |
|---|---|---|---|
| 2,386,622 | 10/1945 | Marshall | 52/83 |
| 3,302,363 | 2/1967 | Frey | 52/745 |
| 3,820,467 | 6/1974 | Burdick | 214/1 BE |
| 3,905,167 | 9/1975 | Watkins | 52/292 |

FOREIGN PATENTS OR APPLICATIONS

| | | | |
|---|---|---|---|
| 432,802 | 9/1967 | Switzerland | 52/79 |
| 937,372 | 9/1963 | United Kingdom | 52/236 |

*Primary Examiner*—John E. Murtagh

*Attorney, Agent, or Firm*—Hopgood, Calimafde, Kalil, Blaustein & Lieberman

[57] ABSTRACT

A modular housing system in which a plurality of housing units are mounted on and between two parallel load bearing longitudinal members. The load bearing longitudinal members can form a part of two partition walls and the housing units are supported on the load bearing longitudinal members at roof level. Each housing unit comprises a load bearing roof and a floor which is suspended from the roof by collapsible load bearing members which are preferably flexible cables. The roof can include two side beams which form a pressurized fluid system for conveying the units along the load bearing longitudinal members.

21 Claims, 10 Drawing Figures

23
29
39
42
41
38
52
51
53
50
40
31
49
45
44
37
20
54
70
47
46
48
19
56
69
18
25
63
12
62
22
57
33
65
67
35
24
64
21

HOUSING SYSTEMS AND STRUCTURES

BACKGROUND TO THE INVENTION

The present invention relates to a housing system or structure of the type in which modular housing units are prefabricated and erected on site.

The increasing demand for low-cost housing has led to the development of modular systems of housing in which a plurality of spaced parallel party walls are built on site from brick or block work to create acceptable fire and sound proof divisions between adjacent rows of housing units and standard housing units are then built on site or prefabricated and erected on site between the party walls.

While this known system of building modular housing has some cost advantages, the building of the brick or block work party walls involves the use of skilled labour. In addition, conventional building methods are usually employed to build or erect the housing units within the party walls, which also involves the use of skilled labour on site.

It is therefore an object of the present invention to provide a housing system of this type in which the partition walls are more economic to erect than was possible hitherto, in which the housing units can be economically prefabricated and transported to the site and in which the housing can be erected and placed in position with a minimum of time and skilled labour.

STATEMENT OF THE INVENTION

A housing structure comprising two parallel, laterally spaced and generally horizontal load supporting longitudinal members and a plurality of housing units mounted between the longitudinal members, each housing unit comprising a load supporting roof which rests on and is supported by the longitudinal members.

Preferably each longitudinal member of the structure is mounted on a plurality of piles driven into the ground in line to form a partition wall. This type of partition wall can be erected quickly and easily with a minimum of skilled labour and can include partition members mounted on the longitudinal members and forming a continuous curtain wall. The partition members can be fire proof panels so that the partition wall forms a fire proof barrier.

Preferably each housing unit comprises a load supporting roof and a floor which is suspended from the roof by load supporting members which are collapsible and preferably flexible. For transport, the floor can rest on and at least partially within the roof so that a plurality of the housing units can be stacked one on top of the other.

Preferably, the roof of each unit is movable along the longitudinal members on a pressurised fluid bed. This enables the units to be quickly and easily moved into position between the longitudinal members with a minimum of labour and machinery.

DESCRIPTION OF THE PREFERRED EMBODIMENT

Figure 1:
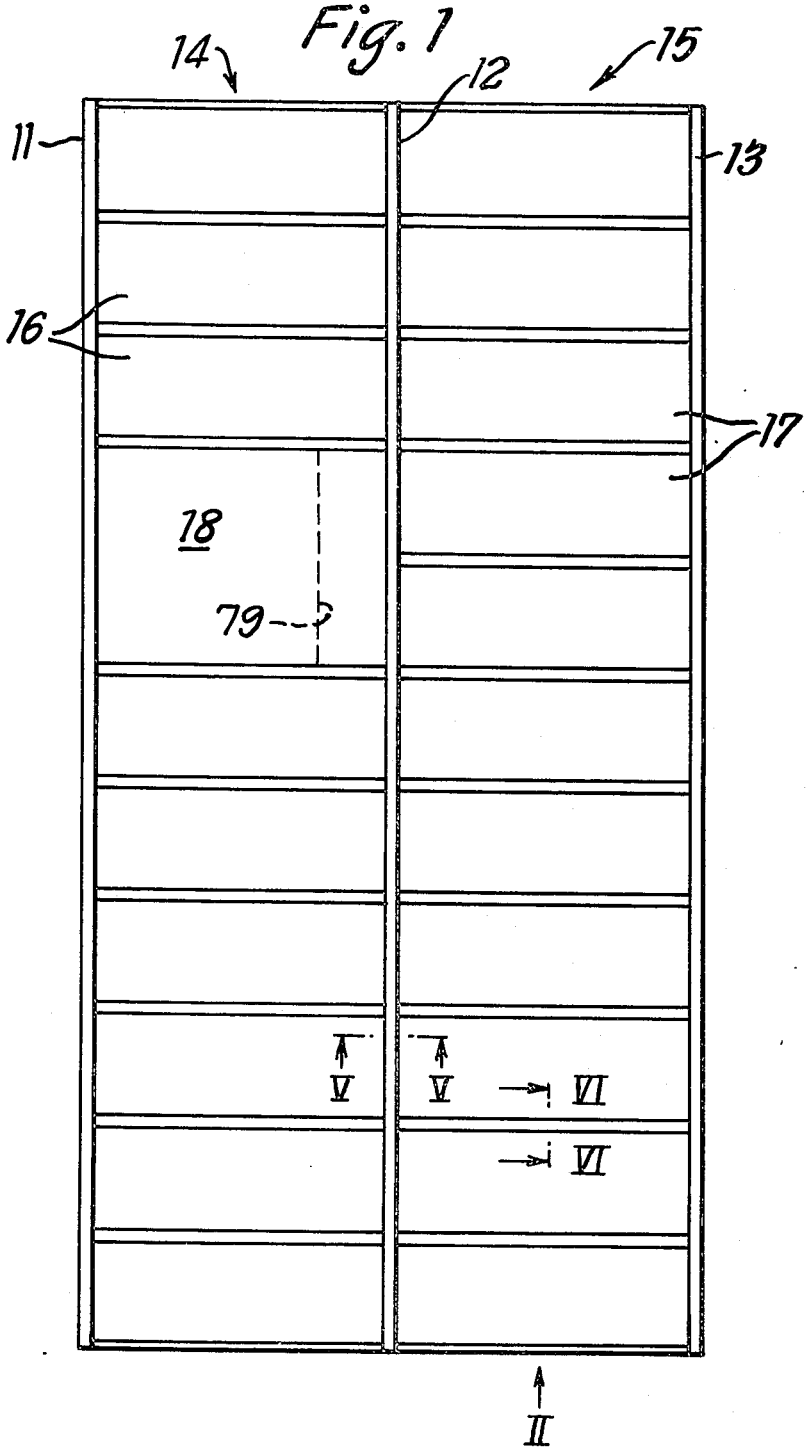
FIG. 1 is a plan view of a housing system according to the present invention.
Figure 2:
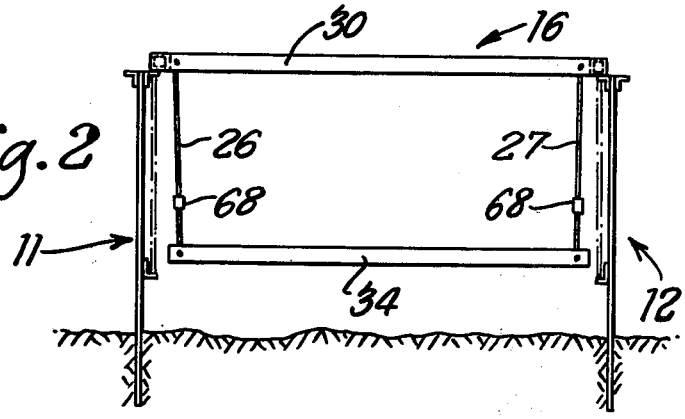
FIG. 2 is an end view, in partly diagrammatic form, of the housing system shown in FIG. 1.

FIG. 1 illustrates a typical housing layout incorporating the housing structure and housing units of the present invention. The layout comprises three parallel partition walls 11, 12 and 13 which form between them two bays 14 and 15. Each bay contains a plurality of housing units 16 and 17 respectively, all of which are similar and which are mounted on and between the walls 11, 12 and 13.

Figure 3:
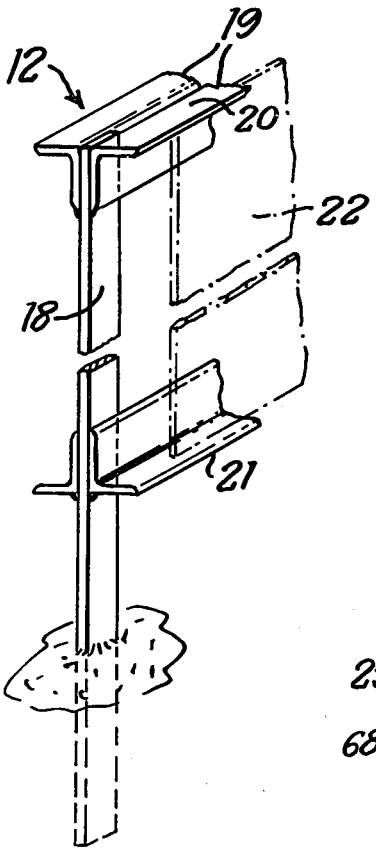
FIG. 3 is a perspective, exploded view of one of the walls of the housing system shown in FIG. 1.

Each partition wall 11, 12 and 13 is built on site and one of the walls 12 is shown in detail in FIG. 3. The wall 12 comprises a plurality of spaced piles 18 which have been driven into the ground by a pile driving machine to a depth which is sufficient to ensure tht they will not readily tilt or move under the load to which they are likely to be subjected to in use. Each pile 18 is shown, for convenience, as a flat steel girder but may in practice comprise a steel girder of any convenient cross sectional shape which projects above ground up to or slightly above the approximate roof height of the housing units.

Horizontal load supporting rails 19 are mounted on the piles 18 at or adjacent the top ends of the pile. Each horizontal load supporting rail 19 comprises an L-shaped girder having a flat load supporting upper face forming a track 20 which is adapted to carry the housing units. Lower horizontal struts 21 are also mounted on the piles 18 and if required, partition panels 22 can be mounted between the members 19 and struts 21 so as to form a continuous curtain wall. The partition panels 22 are preferably formed from sheet steel but can be made from any suitable non-combustible material so that the complete structure provides a load supporting fire proof curtain wall. The struts 21 are preferably spaced above ground level so as to allow access through the walls 11, 12, and 13 at ground level and the gap between the struts 21 and the ground can be closed by providing an asbestos blanket which provides a complete fire proof barrier down to ground level.

Although each wall 11, 12 and 13 of the illustrated embodiment of the invention comprises a plurality of piles and horizontal members mounted on the piles, it is within the scope of the invention to construct conventional brick or block work walls or to mount posts in preformed holes in the ground in place of the piles 18.

Figure 4:
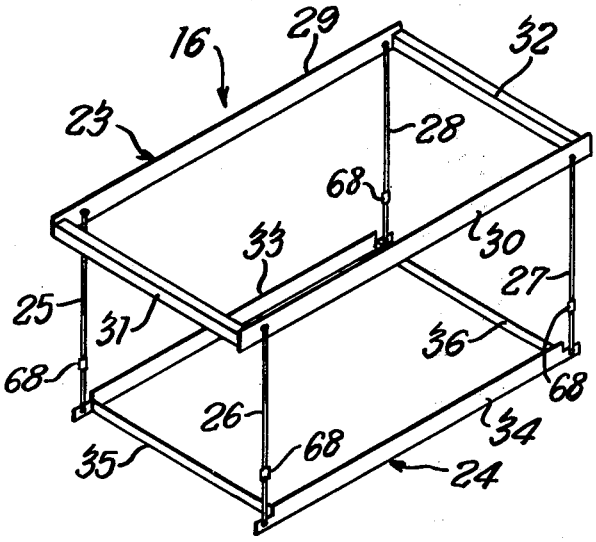
FIG. 4 is a perspective, diagrammatic view of one of the housing units of FIG. 1.

One of the housing units 16 which is mounted between the walls 11 and 12 is shown in diagrammatic form in FIG. 4. The unit 16 comprises a roof frame 23 and a floor frame 24 which is suspended from the roof frame 23 by load bearing flexible cables 25, 26, 27 and 28.

The roof frame 23 which is a load bearing structure, comprises two load bearing side beams 29 and 30 joined by end beams 31 and 32. Similarly, the floor frame 24 comprises two side beams 33 and 34 joined by end beams 35 and 36.

Figure 5:
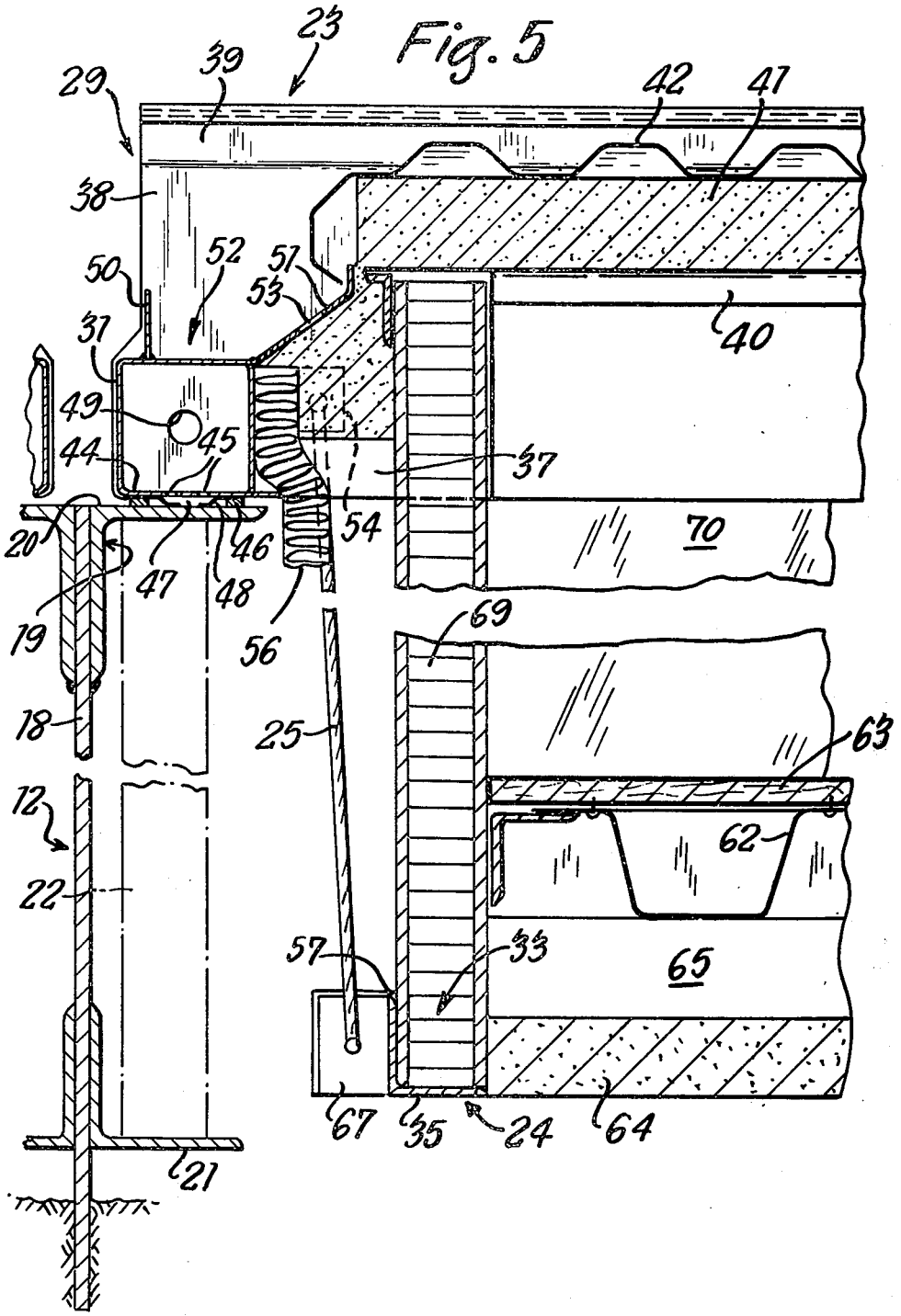
FIG. 5 is a section taken on the line V — V of FIG. 1.
Figure 6:
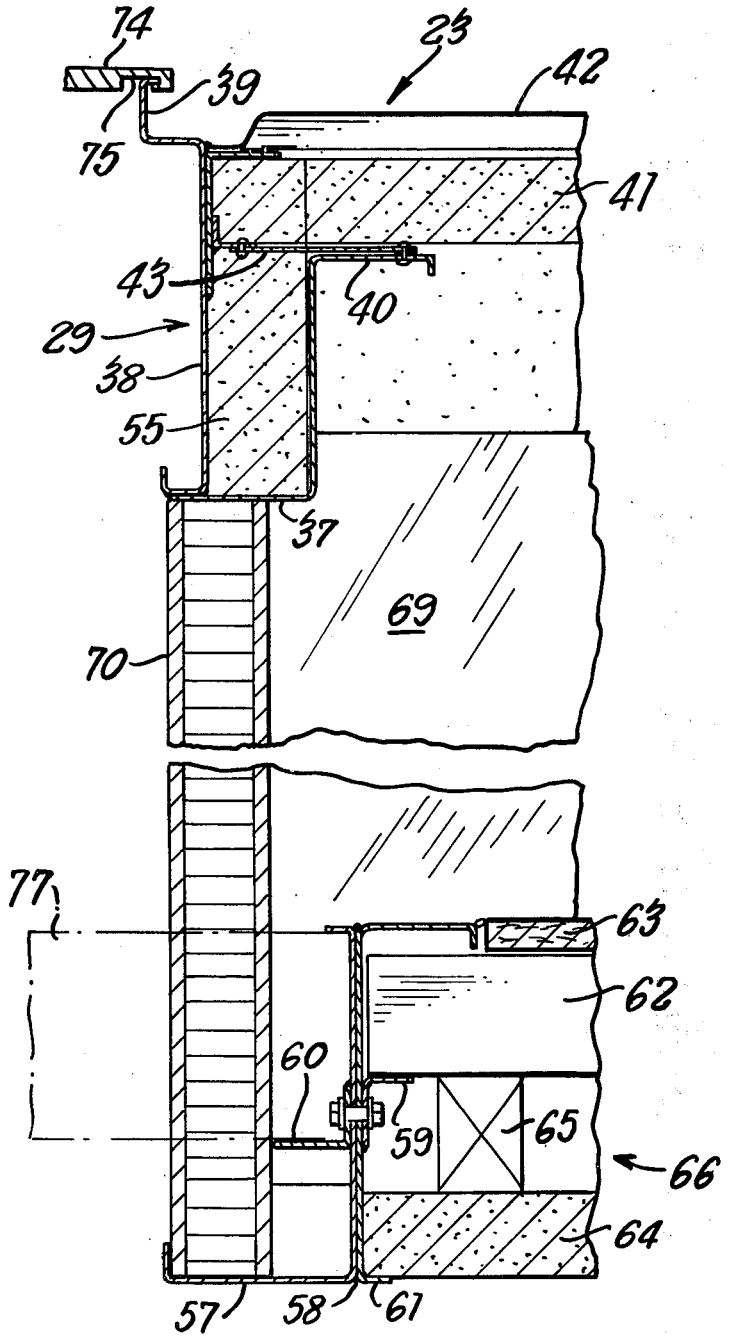
FIG. 6 is a section taken on the line VI — VI of FIG. 1.
Figure 7:
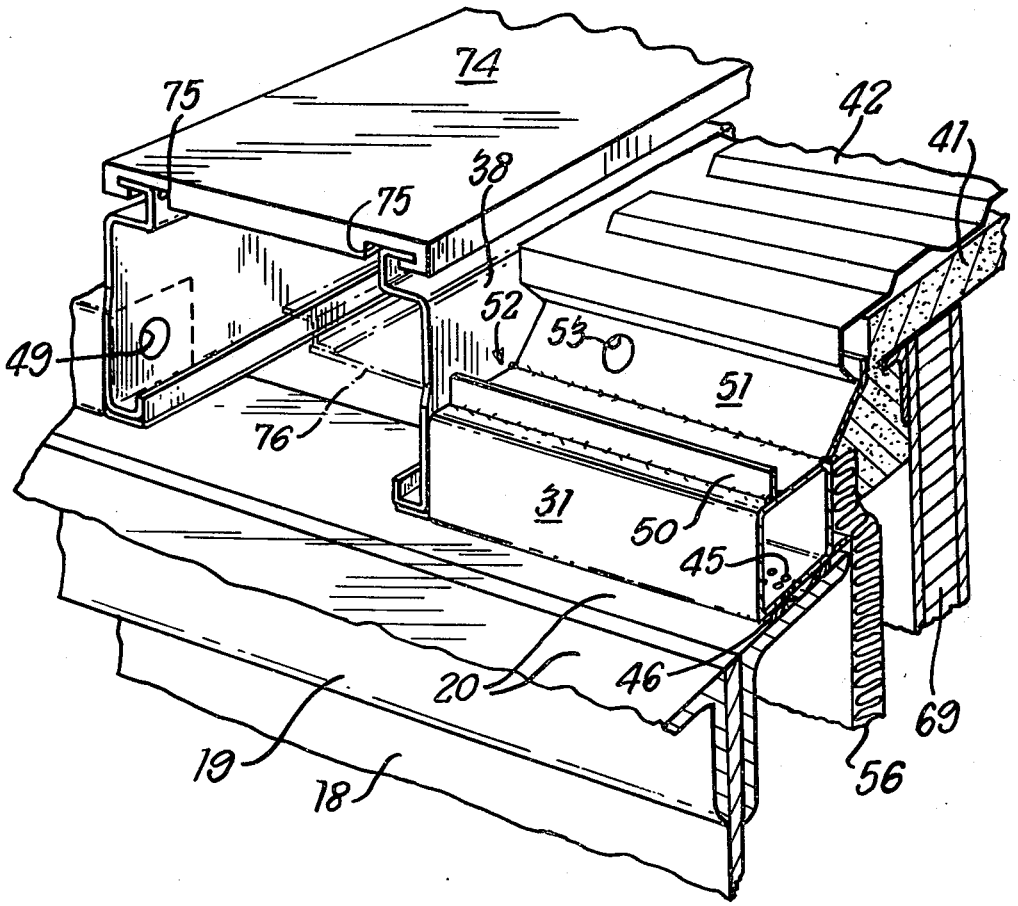
FIG. 7 is a perspective view, partly in section, of a detail of a housing unit.

The construction of the unit 16 is shown in greater detail in FIGS. 5 to 7. Referring first to the roof frame 23, each load bearing side beam 29 and 30 comprises an inner section 37 which is welded to the bottom end of an outer section 38. The outer section 38 projects upwardly beyond the inner section 37 and is formed with a hooked flange 39 at its upper end. The inner section 37 is approximately L-shaped and includes an inwardly projecting horizontal flange 40 which supports insulation panels 41 and outer weather proof deck panels 42. In order to stiffen and strengthen the beam 29 the horizontal flange 40 of the inner section 37 is tied to the outer section 38 by a plurality of struts 43 formed from a material having low heat conductivity, such as plywood. The insulation panels are formed from a sound and heat insulating material and the deck panels are formed from a weather proof material, for instance sheet aluminum. The under-surface of the insulation panels 41 is preferably clad with a pre-painted aluminum foil or sheet.

Each end beam 31 and 32 of the roof frame 23 extends between the side beams 29 and 30 and is welded to the outer sections 38 of the side beams. The inner section 37 of each side beam terminates short of the end of the outer section and the end beams 31 and 32 are welded to the outer sections adjacent the ends of the inner sections 37. Each end beam 31 and 32 is hollow and of box section having a flat bottom wall 44 which is formed adjacent each end of the beam with a plurality of apertures 45. Surrounding the area of the apertures 45 at each end of the beam 31 is a resilient sealing strip 46 which defines a pressurized fluid bed 47 beneath each end of the beam 31. The strip 46 is protected and fully sealed by an impervious flexible skirt 48. Each end wall of the beam 31 is formed with a fluid inlet 49 and fluid under pressure can be injected into the beam 31 from each end of the beam and through the apertures 45 to each fluid bed 47 which is defined by the sealing strip 46 and skirt 48. A fluid bed 47 can be provided at or adjacent each end of the beam 31 or alternatively over the full length of the beam.

The beam 31 also includes two upstanding flanges 50 and 51 which form a gutter 52 and an outlet 53 for rainwater is provided in the sloping side wall 51.

Mounted on the outer section 38 of each side beam 29 and 30 at each end of the beam and adjacent the end beams 31 and 32 are cable support brackets 54. These brackets are positioned adjacent the ends of the load bearing side beams 29 and 30 so that the weight of the floor frame 24 is taken at or adjacent the ends of the side beams where their resistance to bending moments is greatest.

The inner and outer sections 37, 38 of each side beam 29 and 30 form a channel which is filled with strips 55 of insulation material and a flexible curtain 56 of insulation material is attached to the side wall of each end beam 31 and 32.

Referring now to the floor frame 24, each side beam 33 and 34 comprises an approximately L-shaped outer section 57 which is welded to an inner section 58. Inner and outer lugs 59 and 60 respectively are bolted to each side beam at intervals along the beam and the inner section 58 of each beam is formed with a bottom flange 61. The outer section 57 of each side beam 33 and 34 is longer than the inner section 58 and the end beams 35 and 36, which are L-shaped in section are welded to the ends of the outer sections 57. Steel deck panels 62 are mounted on the inner lugs 59 of the inner section 57 of the two side beams 33 and 34 and floor panels 63 are mounted on top of the deck panels 62. Insulation panels 64 rest on the flanges 61 and are spaced from the deck panels 62 by packing members 65 so as to form a void 66 within the floor of the unit. Four cable brackets 67 are mounted on the ends of the outer sections 57 of the side beams 33 and 34 adjacent and outside the end beams 35 and 36.

The floor frame 24 is suspended from the roof frame 23 by the four flexible cables 25, 26, 27 and 28. The cables are preferably steel cables and they may comprise four separate cables each extending between an upper bracket 54 and a lower bracket 67 or, alternatively, the two pairs of flexible cables 26, 27 and 25, 28 may each comprise a single continuous flexible member extending from the roof frame to the floor frame and beneath the floor frame along the length of a side beam of the floor frame and then upwardly through the floor frame to the roof frame. The length of the cables 25, 26, 27, 28 is adjustable by means of screw clamps 68, so that the spacing between the roof frame and the floor frame can be varied.

Located and clamped between the roof panels 41 and the floor panels 63 are end wall panels 69 and side wall panels 70. The panels 69 and 70 are inserted into place as a clearance fit between the roof panels and floor panels and the length of the cables 25, 26, 27, 28 is then reduced so as to securely clamp the wall panels in position. The edge to surface joint between the top and bottom edges of each wall panel and the floor and ceiling surfaces is preferably similar to the joint described in my co-pending British application No. 55670/74.

Figure 10:
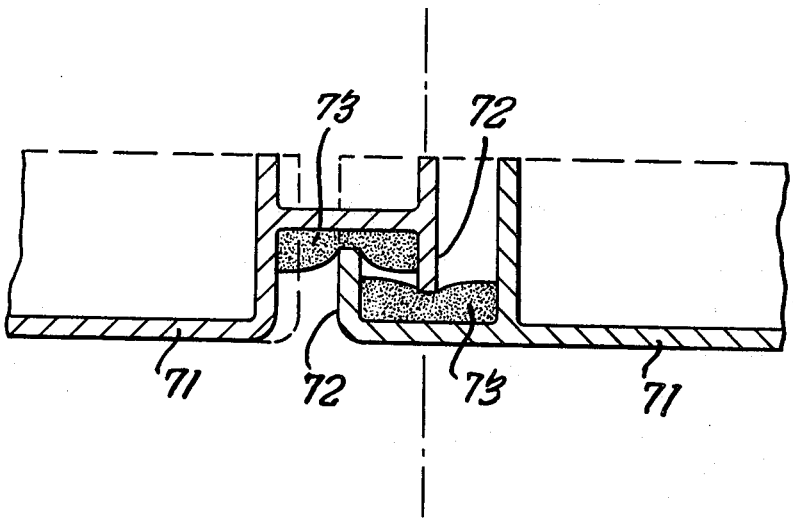
FIG. 10 is a horizontal section through the vertical butt joint between two wall panels of the housing unit.

The adjacent wall panels are butt jointed and can be covered by outer weather proof panels 71 as shown in FIG. 10. The opposite parallel vertical edges of each outer panel 71 are formed respectively with longitudinal hook-shaped flanges 72, which inter-engage to form a butt joint. Sealing strips 73 are also provided on each vertical edge and the flanges 72 are compressed against the sealing strips 73 to form a water tight joint. The outer panels are conveniently attached to the outer section 38 of the beams 29 and 30 and to the outer section 57 of the beams 33 and 34.

Figure 8:
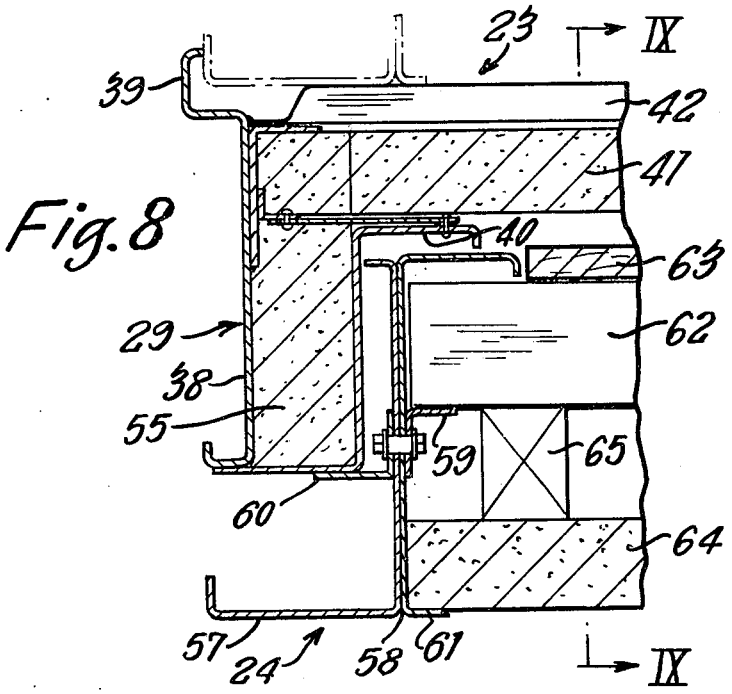
FIG. 8 is an elevation in section of a detail of a housing unit showing the roof frame nested on the floor frame.
Figure 9:
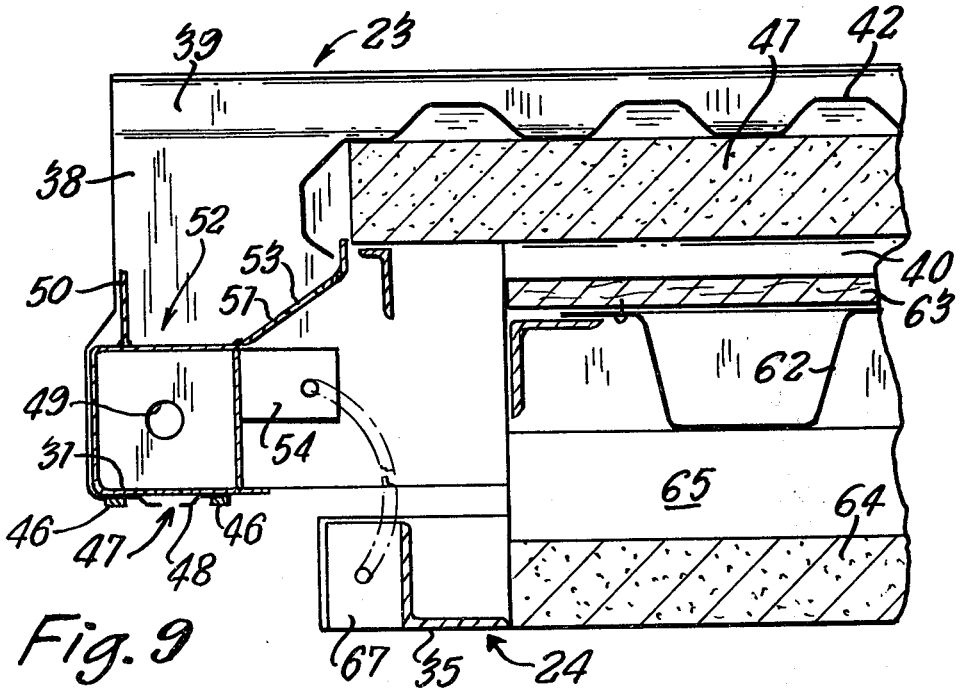
FIG. 9 is a section taken on the line IX — IX of FIG. 8.

As can be seen from FIG. 8, the dimensions of the roof frame 23 and the floor frame 24 are such that the floor frame will nest partially within the roof frame. In the nested position, the side beams 29, 30 of the roof frame nest over the outer sections 57 of the side beams 33, 34, of the floor frame and the hollow side beams 31, 32 of the roof frame are positioned outside the end beams 35, 36 of the floor frame. A further unit can then be stacked on top of the nested unit 20 so that it rests on the deck panels 42 and is retained laterally by the hooked flanges 39 on the side beams 23, 24. The housing units 16 can then be stacked one on top of the other so that they occupy a relatively small space for transport and storage.

When a stack of housing units has been transported on the site, the top unit is lifted away from the stack. A wire or similar lifting member is provided on the top of the roof of each unit and this is used to lift the roof away from the floor of the unit. As the roof is lifted upwardly, the flexible cables 25 to 28 extend until the floor frame 24 comes away from the stack and the insulating curtains 56 unroll and drop at each end of the unit. Temporary bracing struts can be inserted between the roof and the floor and the housing unit is then swung into position at the entrance to one of the bays 14, 15. The end beams 31, 32 of the roof frame 23 of the unit are then aligned with the tracks 20 of the parallel rails 19 of the partition walls 11, 12. The unit 16 is then moved inwardly between the rails 19 and lowered onto the tracks 20. The end beams 31, 32 of the roof frame 23 are then connected up to a source of fluid pressure and the fluid beds 47 are pressurised so as to lift the unit away from the tracks 20. The unit 16 can then be moved manually along the tracks 20 into its final position. The fluid pressure is then released so that the end beams 31, 32 sink back on to the tracks 20.

When the unit 16 is in its final position, the roof frame 23 extends between the walls 11, 12 with the ends of the side beams 29, 30 supported on the horizontal load supporting members 19 of the walls 11 and 12 and with the floor frame 24 suspended beneath the roof frame 23 by the flexible cables 25 to 28. The walls panels 69 and 70 are then inserted into place between the roof frame and the floor frame and finally the cables 25 to 28 are tightened and shortened so as to clamp the wall panels 69, 70 between the roof panels and floor panels.

In order to close the gaps between the roof frames of adjacent units, a roof jointing panel 74 is provided which clips over the hooked flanges 39 of the side beams 29, 30 of adjacent units. As can be seen from FIG. 7, the roof jointing panel 74 is provided with slots 75 to receive the hooked flanges 39 of the side beams 29, 30. The slots are so shaped that the roof jointing panel can be placed in position over the hooked flanges 39 of the adjacent units and the units are then moved apart slightly to lock the panel 74 in position. The space immediately below the roof jointing panel 74 can be used as a service duct and the duct can be provided with a base panel 76 (FIG. 7) which rests on the adjacent outer sections of the side beams of the units. The roof jointing panel 74 can be vented and can be transparent if required.

Referring now to FIG. 1, it will be appreciated that adjacent housing units can be inter-connected by omitting the side wall panels between the adjacent units or by providing doorways in the wall panels.

In the event that it is desired to link two adjacent units together to form an open plan area, then additional floor panels 77 are provided, resting on outer lugs 60 of the adjacent side beams of the two units so as to bridge the gap at floor level between the two units as shown in broken line in FIG. 6.

It will also be seen from FIG. 1 that some units can be omitted to provide an open space or courtyard 78. If an open space is provided, a walkway 79 can be provided at floor level across the courtyard mounted on the lugs 60 of the floor frames of adjacent housing units in the next bay.

The centre wall 12 can be pivoted with partition panels 22 so that it acts as a complete fire proof barrier or alternatively the partition panels 22 can be omitted so as to give access wherever required through the end walls of adjacent units.

The height of the load supporting horizontal members 19 of the walls 11, 12 can be selected so that the floor frames of the units are positioned above ground level so as to allow for a service area beneath the floor frames of the units and for the provision of service pipes and cables to be located above ground level but below the floor panels of the housing units.

It is also envisaged that decking panels can be mounted on or from adjacent series of partition walls to form walkways at the same level as the floor frames of the housing units. As the walkways are thereby also located above ground level a continuous service area is provided below both the housing units and the walkways.

It will be apparent from the above that I have provided a modular housing system which involves a minimum of work and, in particular, skilled labour on site. I have further provided a housing unit which is economical to transport and store since it can be packed and stacked into a very small volume.

It will be appreciated that, while I have illustrated and described the preferred embodiment of my invention, modifications can be made to the partition walls and the housing units without departing from the scope and spirit of the present invention.

What I claim is:

1. A housing structure comprising two parallel, laterally spaced and generally horizontal fixed load supporting longitudinal members and a plurality of separate housing units mounted between said longitudinal members, each of said housing units comprising a load supporting roof and a floor, the ends of said roof resting on, extending between, and being supported by said longitudinal members, and a plurality of load supporting members, said floor being suspended from adjacent the ends of said roof by said load supporting members, said load supporting members allowing for the adjustment of the spacing between said roof and said floor and for the collapse of said roof against said floor for transport.

2. A housing structure as claimed in claim 1, wherein each load supporting longitudinal member is mounted on a plurality of spaced posts.

3. A housing structure as claimed in claim 2, wherein the posts comprise piles driven into the ground.

4. A housing structure as claimed in claim 3, wherein a plurality of partition members are mounted on the load supporting longitudinal members and form a continuous curtain wall.

5. A housing structure as claimed in claim 4, wherein each post comprises a steel girder.

6. A housing structure as claimed in claim 1, wherein each load supporting longitudinal member comprises a part of or is supported by a continuous wall.

7. A housing structure as claimed in claim 1, wherein the load supporting members are flexible.

8. A housing structure as claimed in claim 1, wherein the load supporting members are adjustable for length to alter the spacing between the roof and the floor.

9. A housing structure as claimed in claim 1, wherein the floor of each housing unit is nestable at least partially on and within the roof of the unit whereby a plurality of units can be nested and stacked for transport.

10. A housing structure as claimed in claim 1, wherein the roof comprises two load supporting side beams which extend between and are supported on the longitudinal members, the floor being suspended from adjacent the ends of the side beams of the roof.

11. A housing structure as claimed in claim 10, wherein each of said housing units is supported by and movable along the horizontal longitudinal members.

12. A housing structure as claimed in claim 11, wherein the roof of each of said housing units includes two hollow side beams each having a wall adapted to rest on the longitudinal member and forming a conduit for pressurized fluid, each hollow side beam having outlets for fluid in its said wall for forming a pressurized fluid system at the interface between the beam and the longitudinal member.

13. A housing structure as claimed in claim 12, wherein each side beam has a pressurized fluid bed on its undersurface adjacent the ends of the beam to provide a balanced pressurized fluid system.

14. A housing structure as claimed in claim 13, wherein each pressurised fluid bed is defined by a resilient continuous peripheral wall and a flexible impervious skirt.

15. A modular housing unit comprising a substantially rectangular load-bearing roof comprising two load supporting side beams and a substantially rectangular floor which is suspended from the side beams of the roof at four points adjacent the ends of the side beams by load-bearing members which allow for adjustment of the spacing between the roof and the floor and for collapse of the roof against the floor for transport.

16. A modular housing unit as claimed in claim 15, wherein the load bearing members are flexible.

17. A modular housing unit as claimed in claim 16, wherein the length of the flexible members is adjustable to vary the spacing between the roof and the floor.

18. A modular housing unit as claimed in claim 15, wherein the floor is at least partially nestable within the roof.

19. A modular housing unit as claimed in claim 15, wherein the side beams of the roof are formed by hollow box beams, each box beam having at least one pressurized fluid bed on its under-surface which acts as a pressurized fluid conveyor system for the unit.

20. A method of erecting a plurality of housing units, comprising the steps of erecting two parallel, laterally spaced and generally horizontal load supporting fixed longitudinal members, providing a plurality of separate housing units each of which comprises a load supporting roof and a floor suspended from the roof by load supporting members which allow for adjustment of the spacing between the roof and the floor, mounting the housing units between the longitudinal members with the ends of the roof of each unit resting on and supported by the longitudinal members and the floor suspended from the roof of each unit, inserting wall panels btween the roof and floor of each unit, and adjusting the spacing between the roof and the floor of each unit to clamp the wall panels in position between the roof and the floor.

21. A method as claimed in claim 20, including the further step of sliding each unit into place on the longitudinal members on a pressurized fluid system which forms an integral part of each unit.

* * * * *